United States Patent [19]

Stobb

[11] Patent Number: 4,715,758

[45] Date of Patent: Dec. 29, 1987

[54] METHOD AND APPARATUS FOR ATTACHING SHEETS TOGETHER

[75] Inventor: Walter J. Stobb, Pittstown, N.J.

[73] Assignee: Stobb, Inc., Clinton, N.J.

[21] Appl. No.: 886,606

[22] Filed: Jul. 18, 1986

[51] Int. Cl.[4] ..... B42C 9/00

[52] U.S. Cl. ..... 412/8; 156/253

[58] Field of Search ..... 156/251, 253, 305; 412/6, 8, 33, 37

[56] References Cited

U.S. PATENT DOCUMENTS

| | | | |
|---|---|---|---|
| 2,557,668 | 6/1951 | Lincoln | 154/42 |
| 2,817,513 | 12/1957 | Bell et al. | 270/54 |
| 3,350,249 | 10/1967 | Gregoire | 156/253 X |
| 3,475,249 | 10/1969 | Smith, Jr. | 156/253 |
| 3,814,654 | 6/1974 | Kugel | 156/290 |
| 3,993,523 | 11/1976 | Hunt et al. | 156/148 |

FOREIGN PATENT DOCUMENTS

| | | | |
|---|---|---|---|
| 893375 | 10/1959 | United Kingdom | 156/91 |
| 2106033 | 4/1983 | United Kingdom | 412/8 |

*Primary Examiner*—Paul A. Bell

*Attorney, Agent, or Firm*—Arthur J. Hansmann

[57] ABSTRACT

Method and apparatus for stitching sheets of paper together by means of a hardenable liquid applied to hollow needles which roll with the movement of the stack of sheets moving tangentially to the rotational action of the applicator needles. The needles can be readily arranged in any pattern of applying the hardenable liquid to the stack of sheets, as desired, and the liquid is applied under pressure only at the location of the sheets themselves. Finally, a cover is placed over the stack of sheets with the hardenable liquid not yet set, and thus the cover is automatically glued or adhered to the stack of sheets for a finally neat and complete product.

12 Claims, 6 Drawing Figures

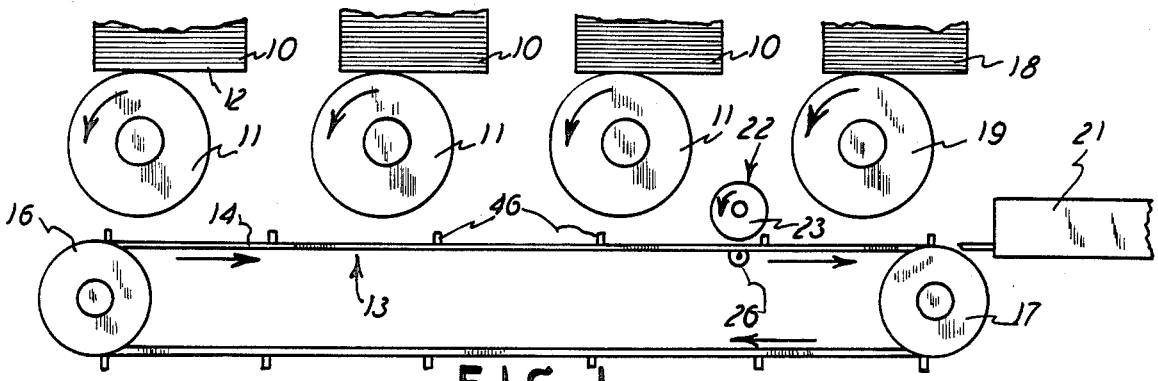
FIG. 1
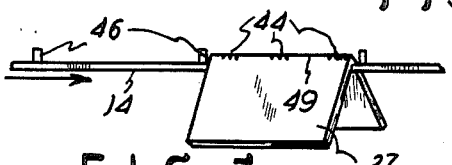
FIG. 5
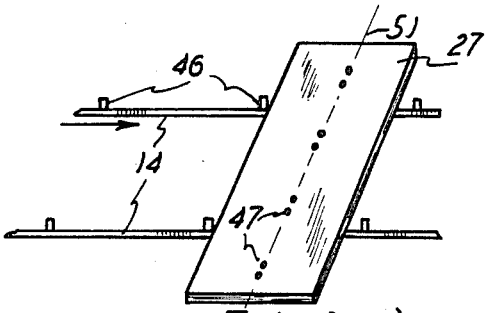
FIG. 6
FIG. 4
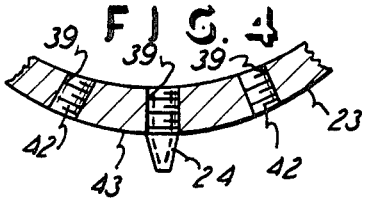
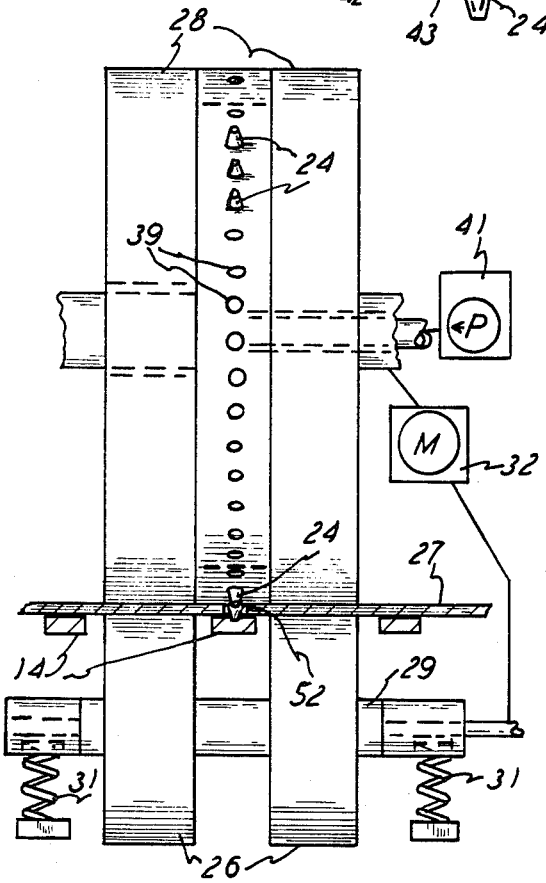
FIG. 3
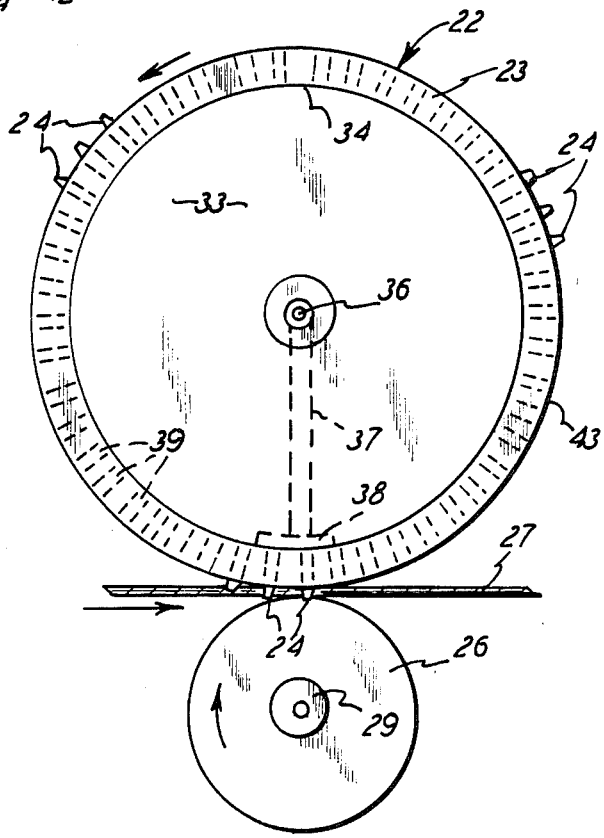
FIG. 2

METHOD AND APPARATUS FOR ATTACHING SHEETS TOGETHER

This inventions relates to a method and apparatus for stitching sheets of paper together, and, more particularly, it relates to doing so by means of a hardenable liquid serving as the stitch, and finally a cover is applied.

BACKGROUND OF THE INVENTION

The prior art is already aware of using a hardenable liquid for forming a stitch or the like in a stack of paper sheets. That is, the concept of gluing sheets together by means of piercing the sheets with a hollow needle carrying a glue or the like is already known. Thus, the piercing of holes in sheets and filling the holes with a hardenable liquid, such as an adhesive or the like, is shown in U.S. Pat. Nos. 3,475,249 and 3,814,654 and 3,993,523 and British Pat. No. 893,375. The aforesaid U.S. Patents show the use of a needle for applying an adhesive to a pierced hole in sheets which are to be secured together by the adhesive. Further, some of the aforesaid patents show the use of a hollow needle which does the piercing and depositing of the glue or adhesive, in one motion. Another prior art example of utilizing a hollow needle and a hardenable liquid for securing sheets together is seen in U.S. Pat. No. 2,557,668, but this patent is only disclosing the formation of a variation for a sewing machine in that it applies a hardenable liquid in an extruding process for binding materials together. Finally, U.S. Pat. No. 2,817,513 shows a collating machine for sheets which it mentions can be stapled or glued together though it does not disclose any teaching for the gluing process.

The present invention differs from the prior art in that it provides a method and apparatus for stitching or securing sheets of paper together by a concept of piercing holes into the sheets and filling the holes with a hardenable liquid, all while the sheets are moving at a non-stop and continuous speed and with the sheets being positioned in sequential stacks all moving through the stitching apparatus in the non-stop process. Further, in this concept, sheets can be stitched either with the in-line stitching arrangement or in the cross-stitching arrangement, both of which are disclosed herein.

Additionally, the present invention provides an arrangement whereby the sheets to be stitched together can be continuously moved through two whirling members with one member thereof carrying the hollow needles and supplying the hardenable liquid. Still further, the hollow needles on the one member can be positioned in desired circumferential positions on the member for providing the desired stitch pattern on the sheets. In that regard, the circumference of the member is related in length to the spacing of the center lines of the stacks of sheets to be stitched together, such that the desired stitching patterns or locations can be achieved in the continuous process being described and disclosed herein. In actuality, the circumference of the one member is equal to the pitch or distance between the center lines of the stacks of sheets times a multiple of a whole number. That is, the so-called pitch of the moving member supporting the sheets times a multiple of a whole number is equal to the circumference on which the hollow needles are located.

Still further, the present invention provides a method and means for supplying the hardenable liquid from a single location or source of supply even though the applicator needles are moving in a circular path around that stationary or single supply source location Accordingly, the present invention provides for the improvement upon the prior art, and it is susceptible to stitching either in the in-line or cross-stitch arrangement, and provides for the desired continuous motion which is the required high speed process for today's graphic arts industry. Also, the process and apparatus of this invention lends itself readily to a selectivity or changing of the stitching pattern for both the in-line and cross-stitch arrangement, all in a simplified and expeditious manner and one which can be accomplished on the job site. A cover is glued on, to form a book or magazine.

Other objects and advantages and differences over the prior art will become apparent upon reading the following description in light of the accompaying drawings.

BRIEF DESCRIPTION OF THE DRAWING

FIG. 1 is a side-elevational view of an overall arrangement of the elements comprising this invention.

FIG. 2 is an enlarged side-elevational view of certain of the elements shown in FIG. 1.

FIG. 3 is an end-elevational view of FIG. 2.

FIG. 4 is a fragmentary sectional view of FIG. 2, on an enlarged scale.

FIG. 5 is a perspective view of a fragment of FIG. 1 and showing an in-line stitch arrangement.

FIG. 6 is a perspective view of a fragment of FIG. 1 and showing a cross-stitch arrangement.

DETAILED DESCRIPTION OF THE METHOD AND APPARATUS

The apparatus described herein in connection with the drawings will also be a description and disclosure of the method aspect of this invention.

FIG. 1 shows a collating system and the stitcher type mechanism of this invention. Thus, three sheet supplies 10 are shown adjacent three sheet feeders 11 which rotate in the direction of the arrows thereon to pick up the bottom one of the sheet 12 in the stacks 10 and convey it to the raceway 13 which is shown in the form of a sheet support or belt 14 movably mounted on end rollers or pulleys 16 and 17, all for moving the belt 14 in the direction of the arrows shown adjacent thereto. Also, a collection of book covers 18 is shown support adjacent a feeder cylinder 19 which also takes a cover and places it onto the raceway 13 on top of the stack of three sheets 12 from the three stacks or piles 10, as mentioned. Finally, the stack of sheets, with the covers thereon, are fed into a cutter and trimmer, generally designated 21.

The foregoing is of a conventional arrangement, and it will be readily understood by anyone skilled in the art. This invention incorporates the stitcher mechanism, generally designated 22, which stitches or secures the stack of sheets 12 together while they are moving on the raceway or support member 14. The stitcher or gluer mechanism 22 is shown to be rotatable, in the direction of the arrow show thereon, so that it rotates at a circumferential speed equal to the linear speed of the belt 14, and thus the entire process of collating and stitching and applying the cover are all done at a continuous and non-stop speed and at a high speed as required in today's graphic arts industry.

FIGS. 2, 3, and 4 show that the mechanism 22 includes a rotatable support or cylindrical member 23 and groups of hollow needles 24 mounted thereon. Also, a roller 26 is disposed adjacent the needle support member 23, and, the sheets 12 are placed in stacked or collated form, designated 27 in FIG. 2, and move between the members 23 and 26 which are in rolling contact with them. Of course it will be seen and understood that the circumferential speed of the members 23 and 26 is equal to the linear speed of the stack of sheets 27.

FIG. 3 shows that the member 23 includes two rotatable sections 28 which are in respective alignment with the two lower rollers 26, all for securely gripping the stack 27 therebetween and to thus hold the stack 27 in a taut condition for the purpose of piercing the stack 27 with holes while the members are rotating and the stack 27 is moving, as mentioned. The lower rollers 26 are mounted on a shaft 29 which is shown to be spring-urged upwardly by springs 31, and thus desired compression and thus control of the stack 27 is achieved. Also, a motor 32 is diagrammatically shown to be connected with the rollers 26 and with the two roller members 28, all for driving them at the respective desired rotational speed so that they have the same circumferential speed, as mentioned.

FIG. 2 further shows that there is a stationary core or central member 33 which is in snug circular contact with the inner circumference 34 of the support member 23. Also, an adhesive or glue or like hardenable liquid passageway 36 extends into the core 33, and there is also a passageway 37 in communication with the passageway 36 which extends radially in the core 33 and to a chamber 38, all for directing flow of the hardenable liquid into the stitcher member being described and to the inner circumference 34 of the rotatable support member 23. The support member 23 has a plurality of radial openings 39 spaced therearound, and those holes 39 are in liquid flow communication with the chamber 38 to receive the liquid from the exterior of the member 23, such as from the liquid pump and supply designated 41. The hollow needles 24 are thus mounted into the openings 39, and therefore receive the hardenable liquid from the chamber 38 when the needles 24 are aligned with the chamber 38, such as shown at the bottom of the member 23 in FIG. 2 where the two needles will be receiving the liquid at that moment. That is, the hardenable liquid is passed to the needles 24 only when the needles are at the location of the stack 27 and are piercing the stack and are therefore then applying the hardenable liquid to the pierced hole in the stack, as desired. FIG. 4 shows the member 23 to have the hollow needle 24 thereon and threaded into the one opening 39, and it further shows that the member 23 has solid plugs 42 in the other two holes 39 to thereby preclude the hardenable liquid from flowing outside the member 23. With this arrangement, the needle 24 receives the hardenable liquid only at the time that it aligns with the chamber 38, and the needle is located to be on the outer circumference designated 43 on the ring or cylindrical member 23.

Therefore, the arrangement is such that the needles 24 can be placed either singly or in groups, such as the groups of three in the three locations shown in FIG. 2. Also, the needles can be readily removed from the member 23 and can be readily positioned in any other opening 39 in the member 23, all as desired for a pattern of stitching of the stack 27. It will of course be readily understood that the member 23 is driven around the stationary member 33, and the members 28 also rotate together with the rotation of the member 23.

FIG. 5 shows the support 14 with a stack of sheets 27 thereon, and it shows that the hardenable material which would be supplied from the pump 41 and through the passageways 36 and 37 and into the chamber 38 and through the needles 24, has been applied at the three locations designated 44. In that arrangement, with the configuration of the needles 24 as shown in FIG. 2, the circumferential distance for all of the needles 24 is such that it would position the stitches as shown at 44 in FIG. 5, and in groups of threes, as shown. That is, the support 14 has pushers or the like 46 which engage the stack 27 to maintain it on the support 14 for movement therewith, and the so-called pitch or distance between the pushers 46 is related to the outer circumference of the member 23, that is the circumferential length along all the needles 24, that being basically the outer circumference 43. Therefore, for every stack 27 moving through the stitcher 22, the member 23 would make one revolution. In all instances, the circumference 43 is equal to the pitch or a multiple by whole number of the pitch of the support 14.

FIG. 6 shows an arrangement whereby the stitcher 22 would be in four sections, side-by-side, each for applying the two stitches 47, as shown in the cross-stitching process of FIG. 6, in contrast to the in-line stitching of FIG. 5, and again as applied to a stack 27. Here also the support or raceway 14 has its pitch related to the circumference 43 by a whole number. This therefore basically means that the circumference 43, that being the total length along all of the needles 24, would be related to the center-line of the stacks, that being the line on which the stitches 44 or 47 appear, since that center-line is the final location of the stitches and is disposed in relationship to the location of the needles 24.

Of course the needles 24 thus form the holes in the stack 27, such as indicated in FIG. 2, and the hardenable liquid is simultaneously applied to the holes, both while the needle is piercing the holes and while the needle is being retracted relative to the holes in the stack 27. Of course upon hardening of the liquid, then the sheets are glued or stitched together, but before the liquid is hardened, the covers 18 are applied over the pierced holes and glue to also have the cover 18 glued to the stack 27 in the usual manner of applying a cover thereto. This arrangement therefore permits the continuous movement of the sheets for collating and stitching and for applying the covers thereto, all in the one station and one continuous movement of the sheets and covers. The glue or adhesive as applied will of course be on top of the stack 27, as well as in the pierced holes, and therefore it will reach the covers 18 and cause the entire book or magazine to be glued together.

Therefore, there is provided the apparatus and method for stitching sheets together, by means of hardenable liquid, and the cover can also be applied to have it adhere to the liquid before it hardens, all for producing a book or magazine of a neat and final presentation. Further, where the hardenable liquid is supplied under necessary pressure, such as by the pump 41, then it is exposed only at the point of actual application, namely, at the chamber 38, and is not being supplied throughout the entire revolution of the member 23 so that the hardenable liquid does not get thrown or otherwise spill at locations beyond the pierced holes of the stack 27.

The in-line arrangement in FIG. 5 is diagrammatic, and that stack has a center-line designated 49. In the cross-stitch of FIG. 6, the center-line is designated 51 and is transverse to the direction of travel of the raceway 13. The sheets are pierced with needle holes at 52.

What is claimed is:

1. A method of binding sheets of paper together by stitching on the center-line of the sheets to form signatures, comprising the steps of continuously collecting the sheets in spaced-apart stacks on a support, moving said support with said stack in a path of movement and at a selected speed, positioning groups of hollow needles in radially extending positions along only one straight line on the circumference of a circular rotatable support and rotating said support to have said needles rotate at said selected speed and into piercing contact with the sheets for forming holes therein on the center-line thereof, the spacing of said groups of said needles on the circular path of rotation being in circumferential spaced-apart groups which are related to said center-lines of said stacks of sheets by a whole number to have said needles pierce said sheets only on the center-lines and at a uniformily spaced-apart positions along said center-lines of successive ones of said stacks, forcing a hardenable liquid through said hollow needles only while said needles are piercing, depositing said hardenable liquid into said holes and into contact with the sheets for binding the sheets together when the liquid hardens, and withdrawing said needles from said holes.

2. The method of binding sheets of paper together, as claimed in claim 1, including the step of supporting said stacks with rollers in rolling contact on opposite faces of said stacks.

3. The method of binding sheets of paper together, as claimed in claim 1, wherein said hardenable liquid is an adhesive material, and including the step of placing a cover over each of said stacks after said adhesive is applied to said stacks and before said adhesive hardens, and with all said steps being performed while said support is moving at said selected speeds.

4. Means for stitching a stack of sheets of paper together, comprising a movable support means for receiving the stack of sheets and moving it along a path at a selected speed, a rotatable mounted hollow applicator means having a circumference disposed to rotate tangentially to said path and having spaced-apart groups of hollow tips radially extending from said circumference and spaced therealong in only one straight line for piercing spaced-apart groups of holes into said sheets and with the linear speed of rotation of said tips being at said selected speed, said hollow tips being exposed to a supply of a hardenable liquid only at the time of the piercing of said sheets for the deposit of said hardenable liquid through said tips and into said holes for the stitching of said sheets together.

5. Apparatus for stitching a stack of paper sheets together, comprising a movable support for receiving said stacks in spaced-apart relation and moving said stacks along a path at a selected speed, a circular member rotatably mounted adjacent said movable support to be in rolling contact with said stacks, groups of hollow needles spaced apart along only one straight line on said circular member to be at the circumference thereof and having radially extending hollow tips for piercing holes into said stacks upon rotation of said circular member, the speed of rotation of said circular member and the radial location of said hollow needles thereon being such that said tips move at said selected speed, and said circular member having a supply of a hardenable liquid and a passageway exposed to said hollow needles only when said holes are being formed, for applying said hardenable liquid into said holes to stitch said sheets together.

6. The apparatus for stitching a stack of paper sheets together, as claimed in claim 5, wherein said stacks have center-lines for the locations of said holes, and said groups of hollow needles being spaced-apart on said circular member in spacings whereby continuous rotation of said circular member and continuous movement of said stacks at said selected speed creates said pierced holes in groups of uniform spaced locations on said center-lines.

7. The apparatus for stitching a stack of paper sheets together, as claimed in claim 5, wherein said movable support includes stack pushers uniformly spaced therealong for engaging said stacks, and the circumferential distance of said groups of said hollow needles completely around said circular member being related by a whole number to the space between every two adjacent ones of said pushers.

8. The apparatus for stitching a stack of paper sheets together, as claimed in claim 5, wherein said circular member has a plurality of radial holes therein on the circumference thereof, and said hollow needles being selectively attached to said circular member only in selected ones of said radial holes.

9. The apparatus for stitching a stack of paper sheets together, as claimed in claim 5, including a central supply of said hardenable liquid in said circular member, and with said central supply being arranged to be exposed to said hollow needles only when said hollow needles are piercing said holes in said sheets.

10. The apparatus for stitching a stack of paper sheets together, as claimed in claim 9, wherein said circular member is cylindrical with radial holes therein extending to said hollow needles, and a stationary core member disposed on the interior of said circular member and with said central supply being in said core member and extending to said radial holes.

11. The apparatus for stitching a stack of paper sheets together, as claimed in claim 5, including rollers mounted adjacent said support and having said rollers disposed on the face of said stacks opposite said one face, all to have said stacks clamped between said rollers and said sid circular member.

12. The apparatus for stitching a stack of paper sheets together, as claimed in claim 5, wherein said hardenable liquid is an adhesive material, and including a cover supplier adjacent said movable support and disposed along said path downstream from said circular member and operable relative to said selected speed for applying a cover to each of said stacks after said adhesive is applied to said stacks and before said adhesive hardens, to adhere said covers to said stacks while said movable support is moving at said selected speed.

* * * * *